United States Patent [19]

Morris

[11] Patent Number: 5,009,165

[45] Date of Patent: Apr. 23, 1991

[54] JACKETED PAINT PELLET

[76] Inventor: James K. Morris, 7004 S. 12th, #2106, Tacoma, Wash. 98465

[21] Appl. No.: 499,556

[22] Filed: Mar. 26, 1990

Related U.S. Application Data

[63] Continuation-in-part of Ser. No. 273,850, Nov. 18, 1988, abandoned.

[51] Int. Cl.[5] ..... F42B 12/40; A63B 65/02

[52] U.S. Cl. ..... 102/513; 102/501; 273/418

[58] Field of Search ..... 273/418; 102/501, 502, 102/513, 444; 244/3.24, 3.23, 3.3

[56] References Cited

U.S. PATENT DOCUMENTS

| | | | |
|---|---|---|---|
| 1,300,709 | 4/1919 | Edison | 244/3.24 |
| 3,031,966 | 5/1962 | Metzger | 102/513 |
| 3,147,011 | 9/1964 | Lemelson | 273/418 |
| 3,190,654 | 6/1965 | Ross | 273/418 |
| 3,649,020 | 3/1972 | Hall | 273/418 |
| 4,413,564 | 11/1983 | Brown | 102/501 |
| 4,686,905 | 8/1987 | Szabo | 102/444 |

FOREIGN PATENT DOCUMENTS

| | | | |
|---|---|---|---|
| 1235922 | 6/1971 | United Kingdom | 244/3.23 |
| 2121522 | 12/1983 | United Kingdom | 102/501 |

*Primary Examiner*—David H. Brown

*Attorney, Agent, or Firm*—Cassidy, Vance & Tarleton

[57] ABSTRACT

A Jacketed paint pellet (10) comprising a jacket (12) having a paint pellet (14) attached thereto. The jacket (12) includes a body (16) having a trailing end (18) and a leading end (20) with a forward facing mounting surface (22). Ribs 28 project radially outward from the body (16) to support the body within the bore of a gun barrel and to guide and stabilize the jacketed paint pellet (10) in flight. Flange members (30) extend laterally from the ribs (28) for additional support and stability. A counterweight portion (36) extends axially in the interior (32) of the body (16) to counterbalance the weight of the paint pellet (14).

23 Claims, 2 Drawing Sheets

JACKETED PAINT PELLET

This is a continuation-in-part of the prior application Ser. No. 07/273,850 filed on Nov. 18, 1988, now abandoned. The benefit of the filing dates of which are hereby claimed under 35 U.S.C § 120.

TECHNICAL FIELD OF THE INVENTION

The present invention pertains to projectiles and, more particularly, to jackets for gelled paint pellets to support the pellet in a gun barrel and guide the pellet in flight.

BACKGROUND OF THE INVENTION

Modern versions of field games, such as "capture the flag", and other strategic pursuit activities utilize paint pellets discharged from a gun as a visual indicator of a "hit" on a player or target. Typically, these paint pellets are spherical projectiles formed of gelled paint that are launched or fired from pisotls and rifles powered by a compressed gas such as $CO_2$. Pellets are loaded into a gun individually through a loading tube. In order to avoid permanent marking of an object or a player and to avoid permanent damage to the environment, these paint pellets are formed of water soluble paint gel.

A serious drawback to the use of gelled paint pellets is their tendency to break apart when being loaded or discharged. When this happens, the gelled paint blocks the passage of other pellets through the loading tube or the bore of the gun barrel. This necessitates partial disassembly and cleaning of the gun, rendering it useless and leaving a player vulnerable to attack until the gun is cleaned and reassembled. Because the paint pellets are fragile, multiple rounds cannot be loaded with a clip or cartridge. Rather, loading must be done by manually inserting each pellet into the chamber of the gun or into a loading tube. Another drawback is the unstable flight characteristics of the pellets. Typically, these pellets have an error factor of $\pm 8$ inches per 100 feet of travel. Furthermore, due to the high muzzle velocity achieved with compressed gas, these pellets easily become deformed and either break apart upon discharge from the gun or deviate from the desired path of travel.

SUMMARY OF THE INVENTION

In accordance with this invention, a jacket for supporting a paint pellet in the bore of a gun barrel and for providing stable flight characteristics is provided. The jacket comprises a body having a leading end and a trailing end, with a forward facing mounting surface on the leading end to which is mounted the paint pellet. The jacket further includes supporting and guiding means in the form of ribs radially projecting from the body to support the paint pellet in the gun barrel and guide it through the air.

In accordance with another aspect of the present invention, the jacket is constructed of lightweight nonmetallic biodegradable material to prevent damage to the environment.

In accordance with a further aspect of the present invention, a counterweight is axially aligned within the body to provide dynamic stability to the jacketed paint pellet during flight. Furthermore, the body is tapered downward from the trailing end to the leading end with the trailing end having a diameter that is substantially the same as the bore of the gun barrel to prevent the escape of air between the jacket and the bore of the gun barrel.

In accordance with still yet another aspect of the present invention, each radially projecting rib has extending from it at least one flange that extends at least partially around the circumference of the body to act as a bearing member to support the jacket body in the bore of the gun barrel and to stabilize and guide the jacketed paint pellet during flight.

As will be readily appreciated from the foregoing description, the present invention provides a jacket for a paint pellet that supports the pellet in the bore of a gun barrel, preventing contact between the pellet and the barrel during discharge to eliminate breaking up of the pellet in the gun barrel and subsequent blocking of the barrel. In addition, multiple rounds of the jacketed paint pellets can be quickly loaded by means of a clip or cartridge that is inserted into the gun. The jacketed paint pellet achieves greater accuracy because it is guided through the air by the ribs. The addition of the flange members to the ribs provides added support in the gun barrel and gives additional stability to the jacketed paint pellet during flight. The counterweight, which is axially aligned within the body of the jacket, prevents the projectile from tumbling in flight. Finally, the use of biodegradable materials to construct the jacket prevents permanent damage to the environment.

BRIEF DESCRIPTION OF THE DRAWINGS

The foregoing and other features and advantages of this invention will be more readily appreciated as the same becomes better understood by reference to the following detailed description when taken in conjunction with the accompanying drawings wherein.

DETAILED DESCRIPTION OF THE PREFERRED EMBODIMENT

Figure 1:
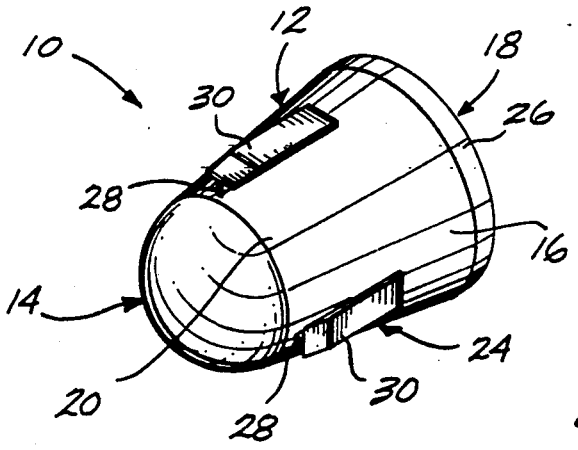
FIG. 1 is an isometric view of a jacketed paint pellet formed in accordance with the present invention.
Figure 2:
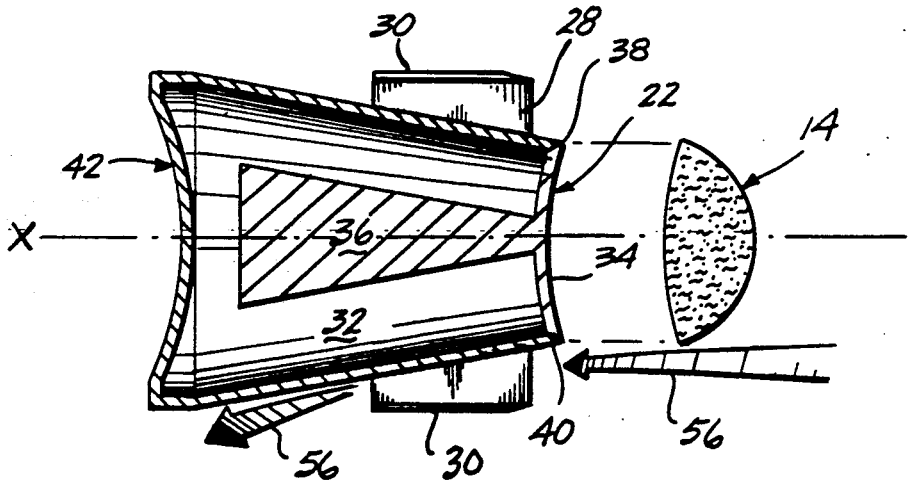
FIG. 2 is a cross-sectional view of the jacketed paint pellet of FIG. 1 showing the paint pellet separated from the jacket for clarity.

Referring initially to FIGS. 1 and 2, the jacketed paint pellet 10 comprises a jacket 12 and a paint pellet 14 attached thereto. The jacket 12 includes a body 16 having a trailing end 18 and a leading end 20. The paint pellet 14 is attached to a forward facing mounting surface 22 (described more fully below) that is located at the leading end 20 (shown in FIG. 2). The body 16 is formed in the shape of a truncated cone, such that the wall 24 tapers downward in diameter from the trailing end 18 to the leading end 20. The trailing end 18 of wall 24 has a flat annular end section 26 that supports the trailing end 18 within a gun barrel. Ideally, the outside diameter of the end section 26 is only slightly less than the inside diameter of the bore of a gun barrel to prevent the escape of the compressed gas charge and to thereby give the jacketed paint pellet 10 the maximum muzzle velocity possible for the given charge.

Positioned around the outside diameter of the tapered portion 24 are a plurality of radially extending ribs 28 having flange members 30 extending laterally outwardly from the top surface thereof. Preferably the flange members 30 are arcuately-shaped to match the curve of the bore of the gun barrel. In the representative embodiment depicted in FIG. 1, four ribs 28 are used (one rib being hidden from view on the far side of the body 16); however, it is possible to use as few as two ribs 28 with flanges 30 and still provide adequate support within the bore of the gun barrel. The use of four ribs 28 gives optimal flight stability without adding unnecessary weight or complexity to the structure.

In the cross-sectional view shown in FIG. 2, it can be seen that the body 16 has a hollow interior 32 that is closed off by a plug 34. The plug 34 includes a counterweight portion 36 and the forward facing mounting surface 22. With the plug 34 installed in the body 16, the counterweight portion 36 extends into the interior 32 and is axially aligned with the longitudinal axis X of the jacketed paint pellet 10. The counterweight portion 36 is tapered outward towards the trailing end 18 of the body 16 to balance the weight of the paint pellet 14 attached to the leading end 20 of the body 16, thereby keeping the center of gravity near the center of the jacketed paint pellet 10. As a result, the jacketed paint pellet 10 will have stable flight characteristics and not tumble after it exits the muzzle of the gun. The forward facing mounting surface 22 has sides 38 that are tapered inwardly to fit with a correspondingly tapered rim 40 on the body 16 to achieve a flush mounting of the plug 34 to the body 16. Ideally, the forward facing mounting surface 22 is slightly concave to match the shape of the paint pellet 14 to aid in preventing deformation of the pellet 14 during discharge and to align the pellet 14 on the plug 34 during construction. The trailing end 18 has a back surface 42 that is concave such that when the charge of compressed gas is released, its impact on the back surface 42 will cause the outside diameter of the end section 26 to slightly expand to achieve a substantially air tight seal between the jacket 12 and the inside surface of the bore of the gun barrel to prevent the escape of the gas charge around the body 16. The pellet 14 is attached to the mounting surface 22 by any suitable adhesive.

In constuction, the body 16 and the plug 34 are constructed of lightweight nonmetallic biodegradable, and preferably water soluble material such as wood pulp, pasta or rice. The adhesive used between the plug 34, the body 16 and the paint pellet 14 is compatible with the jacket material and the paint pellet, as well as being biodegradable. Suitable adhesive would be a flour based paste or white glue.

Figure 3:
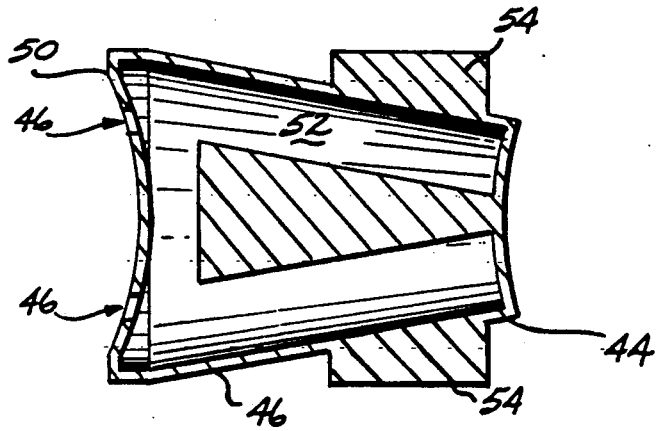
FIG. 3 is a cross-sectional view of an alternative embodiment of a paint pellet jacket formed in accordance with the present invention.

FIG. 3 shows an alternative embodiment of the present invention wherein the jacket 44 has a body 46 constructed from a single piece of material. When constructed from a single block of material, openings 48 will be formed in the back surface 50 of the body 46 to permit forming of the hollow interior 52. In this embodiment the ribs 54 have no laterally extending flanges. As such, the ribs 54 will support the body 46 within the bore of the gun barrel and guide the jacketed paint pellet in flight similar to the manner in which the fletching or feathers of an arrow guide it in flight.

In use, the jacketed paint pellet 10 is first loaded into the chamber of the gas gun. Because the jacket protects the paint pellet 14, against all but forward contest loading can be quickly performed by inserting a clip containing multiple jacketed paint pellets 10 into the gun. To fire, the compressed gas is discharged, usually by pulling the trigger of the gun. As the gas impacts the concave back surface 42, the outside diameter of the trailing end will expand to cause surface 26 to bear against the inside wall of the bore of the barrel of the gun, sealing the gas behind the body 16 and causing the jacketed paint pellet 10 to be propelled out of the barrel. In flight, the jacketed paint pellet 10 remains stable because of the counterbalancing action of the counterweight 36 and the effect of the flow of air past the ribs 28 and the flanges 30. As shown in FIG. 2, the air flow, represented by the arrows 56, passes between the flanges 30 and the paint pellet 14 will and the jacket 12 will quickly decompose with no adverse effect on the environment.

Figure 4:
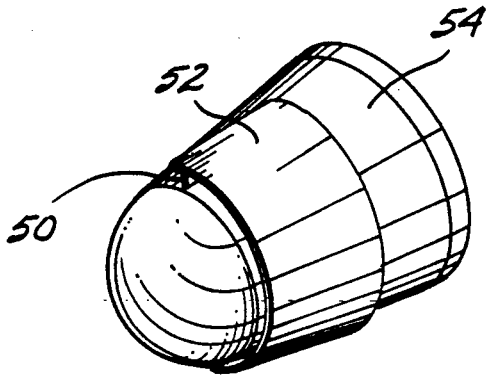
FIG. 4 is an isometric view of another alternative embodiment of a paint pellet jacket formed in accordance with the present invention.

While a preferred embodiment of the invention has been illustrated and described, it is to be understood that various changes can be made therein without departing from the spirit and scope of the invention. For example, in the embodiment depicted in FIG. 4, only one radially extending rib 50 could be used in conjunction with a flange 52 that would extend at least 180° around the outside circumference of the body 54. Consequently, it is not intended that the invention be limited by the disclosure or by such modifications, but instead that its scope should be determined entirely by reference to the claims which follow hereinbelow.

The embodiments of the invention in which an exclusive property or privilege is claimed are defined as follows:

1. A jacket for holding and stabilizing a gelled pellet of paint as it travels through the bore of a gun barrel and in flight, the jacket comprising:

a body formed of lightweight nonmetallic material having a leading end and a trailing end, the leading end having a forward-facing substantially concave mounting surface means connected to said body for supporting said body within the bore of the gun barrel and means connected to said body for guiding the body through the air in flight.

2. The jacket of claim 1, wherein the body has a longitudinal axis and is frustoconically shaped, having a tapered portion that tapers downward in diameter from the trailing end to the leading end.

3. The jacket of claim 2, wherein the diameter of the trailing end is substantially equal to the inside diameter of the bore of the gun barrel to prevent the escape of pressurized gas around the body during discharge to thereby achieve a maximum muzzle velocity of the jacketed paint pellet.

4. The jacket of claim 2, further including a counterweight means on the body to counterbalance the weight of a paint pellet on the body and stabilize the jacketed paint pellet in flight.

5. The jacket of claim 2, wherein the jacket is formed of biodegradable material.

6. The jacket of claim 2, wherein the supporting means and the guiding means comprise at least one rib projecting radially outward from the body.

7. The jacket of claim 6, wherein the supporting means and the guiding means further comprise at least one flange extending laterally from the at least one rib for supporting the body in the bore of the gun barrel and stabilizing the jacket in flight.

8. The jacket of claim 7, wherein the at least one flange has an arcuate cross section and the at least one flange member extends at least 180° around the circumference of the body.

9. The jacket of claim 8, wherein the at least one rib projects radially outward from the tapered portion of the body.

10. The jacket of claim 9, wherein the diameter of the trailing end is substantially equal to the inside diameter of the bore of the gun barrel to prevent the escape of pressurized gas around the body during discharge to achieve a maximum muzzle velocity of the jacket.

11. The jacket of claim 9, further including a counterweight means on the body to counterbalance the weight of a paint pellet on the jacket and stabilize the jacketed paint pellet in flight.

12. The jacket of claim 9, wherein the body is formed of biodegradable material.

13. A jacketed paint pellet for discharge through the bore of a gun barrel comprising:

a pellet of paint;

a body member formed of lightweight nonmetallic material having a leading end and a trailing end, the leading end having a forward-facing substantially concave mounting surface to which the pellet of paint is attached; and means connected to said body for supporting the body member within the bore of the barrel and means connected to said body for guiding the jacketed paint pellet through the air during flight.

14. The jacketed paint pellet of claim 13, wherein the body member is constructed of biodegradable material.

15. The jacketed paint pellet of claim 13, further comprising a counterweight means to counterbalance the weight of the paint pellet mounted on the body member.

16. The jacketed paint pellet of claim 13, wherein the body member has a longitudinal axis and a tapered portion that tapers downward from the trailing end to the leading end.

17. The jacketed paint pellet of claim 16, wherein the body member is frustoconically shaped and the trailing end has an outside diameter slightly less than the inside diameter of the bore of the barrel to prevent the escape of pressurized gas around the body member during discharge to achieve a maximum muzzle velocity of the jacketed paint pellet.

18. The jacketed paint pellet of claim 17, wherein the supporting means and the guiding means comprise at least one rib projecting radially outward from the body member to support the jacketed paint pellet inside the bore of the barrel and stabilize the jacketed paint pellet during flight.

19. The jacketed paint pellet of claim 18, wherein the supporting means and the guiding means further comprise at least one flange member extending laterally from the at least one rib for bearing on the bore of the barrel and stabilizing the jacket in flight.

20. The jacketed paint pellet of claim 19, wherein the at least one flange member has an arcuate cross-sectional shape and extends at least 180° around the circumference of the body.

21. A jacketed paint pellet for discharge through the bore of a gun barrel comprising:

a frustoconically-shaped body having a longitudinal axis, a leading end, a concave front surface on said leading end, a trailing end, a concave rear surface on said trailing end, and a tapered portion that tapers downward in diameter from said trailing end to said leading end;

one or more ribs projecting radially outward from said tapered portion, each of said ribs having a top surface that is parallel to the longitudinal axis of said body and a front surface that is substantially perpendicular to the longitudinal axis; and a paint pellet consisting solely of gelled paint adhesively attached to said concave front surface, said concave front surface further having a diameter substantially equal to the diameter of said paint pellet to protect said paint pellet and prevent fragmentation of said paint pellet during discharge through the bore of the gun barrel and during flight.

22. The jacketed paint pellet of claim 21, further comprising at least one flange member extending laterally from said at least one rib for bearing on the bore of the barrel during discharge and stabilizing the jacketed paint pellet during flight.

23. The jacketed paint pellet of claim 22, wherein said at least one flange member has an arcuate cross-sectional shape.

* * * * *